US005958257A

United States Patent [19]

Regelbrugge et al.

[11] Patent Number: 5,958,257

[45] Date of Patent: Sep. 28, 1999

[54] PROCESS FOR TREATING BRASS COMPONENTS TO REDUCE LEACHABLE LEAD

[75] Inventors: Michael W. Regelbrugge, Reynolds; George V. Richey, Lafayette, both of Ind.; Edward L. Cote, Novi, Mich.; Lane D. Tickanen, Madison, Wis.

[73] Assignee: Gerber Plumbing Fixtures Corp., Chicago, Ill.

[21] Appl. No.: 08/780,478

[22] Filed: Jan. 7, 1997

[51] Int. Cl.[6] ..... C23C 22/63

[52] U.S. Cl. ..... 216/2; 134/2; 134/3; 148/525; 148/545; 148/553; 148/558; 216/105; 216/106; 216/94

[58] Field of Search ..... 134/2, 3; 148/525, 148/545, 553, 558; 216/105, 106, 94

[56] References Cited

U.S. PATENT DOCUMENTS 4,333,785 6/1982 Erickson ..... 156/281

5,601,658 2/1997 Marinas et al. ..... 134/3

*Primary Examiner*—James C. Housel
*Assistant Examiner*—Quang N. Phan
*Attorney, Agent, or Firm*—Rockey, Milnamow & Katz, Ltd.

[57] ABSTRACT

A process for the treatment of brass components to reduce leachable lead therefrom when the component is exposed to water in which the brass component is first treated with an aqueous caustic solution to remove some of the leachable lead therefrom. Thereafter, the brass component is leached to remove excess caustic and then contacted with a water soluble carboxylic acid to remove most of the remaining leachable lead. It has been found that the efficiency of the process can be significantly enhanced through the use of ultrasonic agitation to ensure intimate contact between the treating solutions and the brass component. In the practice of the invention, the amount of lead removed is sufficient to meet the most stringent regulatory requirements for water quality.

17 Claims, No Drawings

PROCESS FOR TREATING BRASS COMPONENTS TO REDUCE LEACHABLE LEAD

This invention is directed to the treatment of brass components to reduce leachable lead, particularly when the brass component is exposed to water.

BACKGROUND OF THE INVENTION

As is well known in the art, brass is an alloy composed principally of copper, lead and zinc and is widely used in a variety of applications in which it comes into contact with substances intended for human consumption. Brass has been widely used for plumbing fittings, bronze alloy and a host of other applications. Perhaps the most widespread application of brass is its use in the manufacture of faucets, valves, fittings and related products intended for use in delivering potable water within a commercial or residential structure. In that application, brass alloys are composed primarily of copper and zinc, with relatively small amounts of lead having been added to render the brass workable and machinable.

Such machinability is desirable in that it facilitates finishing of the components of faucets, valves, fittings and related products and cutting of threads and the like.

It is well known that lead atoms, because of their atomic size, are larger than copper or zinc and, as a result, lead exhibits a relatively low solubility in solid solution in brass alloys. That, in turn, promotes the tendency of lead to precipitate in lead-rich regions dispersed throughout brass alloys. The tendency toward precipitation is particularly notable near the surface of such brass components. That leads to the advantage of improving the machinability of the brass adjacent to the surface thereof, but, at the same time, increases the tendency of lead present on the surface to leach into water.

For many years, the amount of lead leached into foods and liquids from modern lead-containing plumbing was generally regarded as low enough that it presented no substantial risk to persons ingesting foods and liquids coming in contact with such plumbing and like brass components. However, recent standards have significantly limited the amount of permissible leaching of lead and lead exposure at both the state and federal levels. One such example is the Safe Drinking Water Act, amended in 1988 to limit lead in solders and fluxes to 0.2% and to limit lead in public water supply pipes and fittings to 8%.

Similarly, efforts have been underway to limit the amount of lead found in food or water. California, for example, has promulgated regulations limiting lead exposure of an individual to less than 0.5 micrograms per day. On the Federal level, the EPA, in 1991, restructured the standard of lead in drinking water from 50 parts per billion to 15 parts per billion.

While the amount of lead that can be leached from brass plumbing components is generally low, it is nonetheless possible that the amount of lead that can be leached from such components may exceed current or planned standards. It has been proposed that standards be made even more stringent so that lead is omitted totally from the brass alloy or that the brass be treated so that minimum quantities of lead may be leached from such brass components.

It has also been proposed to control lead by chemical treatment to cause the lead to precipitate from water or to change its oxidation kinetics. To that end, it has been suggested that lead may be eliminated or minimized by controlling the pH of water containing trace amounts of lead using alkaline treating agents such as calcium oxide, calcium chloride and alkali metal hydroxides, carbonates and bicarbonates. It has also been proposed to employ alkaline phosphate salts and silicates to minimize corrosion. Either of those treatment steps, when used alone, may not be effective in water at some pH levels or such treatments, when used alone, may require high concentrations and extended periods of time to assure effectiveness.

Various other techniques have been used in the prior art to minimize the leaching of lead into drinking water. For example, it has been suggested that brass faucets, valves, fittings and related products can be treated in a copper chloride bath maintained at a low pH. Unfortunately, however, the effectiveness of that treatment is somewhat erratic, and the low pH's required can represent a health hazard to workers. Similarly, other copper treatments such as treatment with copper acetate have likewise been proposed, but those techniques are expensive and may be difficult to operate, particularly in terms of the removal of copper ions from waste waters.

It is accordingly an object of the present invention to provide a simple and inexpensive process for the treatment of brass components, such as faucets, valves, fittings and related products, to reduce leachable lead when the component is exposed to water.

It is a more specific object of the invention to provide a method for the treatment of brass components which is also effective in the treatment of red brass along with yellow brass.

It is yet a further object of the invention to provide a method for the treatment of brass components to reduce leachable lead therefrom which is simple and inexpensive to operate and which is effective in meeting current regulatory standards.

It is yet a further object of the invention to provide a method for the treatment of brass components which has the capability of providing dramatically reduced lead leachate test results in the form of "Q Statistics," determined in accordance with NSF International Standard 61, Section 9 which is used as the current standard by which lead content of potable water is determined.

SUMMARY OF THE INVENTION

The concepts of the present invention reside in a process for the treatment of brass components to reduce leachable lead therefrom in which the brass components are chemically treated to remove substantially all of the leachable lead, including the lead from the lead-rich regions near the surface of the components. The process is applicable to remove leachable lead and certain other metals from brass plumbing fixtures and fittings such as faucets, shower heads, valves, pipes, pipe fittings, water meters, water pressure and flow regulators meeting the National Sanitation Foundation ("NSF") requirements for such fittings as well as the requirements of the various states to provide water containing less than 11, and preferably less than 5, parts per billion of lead. In contrast, for example, red brass components (not treated using the invention) have been known to provide water sometimes containing in excess of 400 parts per billion of lead.

In the practice of the invention, the brass component is first treated with a hot caustic wash solution to remove dirt and residues from the casting of such components and to remove most of the leachable lead from the component. After rinsing with water, the component is then dipped in a water soluble carboxylic acid, and preferably acetic acid, to remove substantially all of the remaining leachable lead of the component. It has been found that the specific combination of treatment steps insures that the leachable lead from the treated components meets the most demanding of the regulatory standards.

In accordance with one embodiment of the invention, it has been found that, in some cases, it is advantageous to employ what can be described as a chemical milling operation as a pretreatment step to remove surface metal from the interior of such plumbing fixtures. In accordance with this embodiment of the invention, it has been found that the treatment of the plumbing fixtures with a strong acid can be used to remove surface metal in those situations where the interior of such plumbing fixtures have surface roughness. That technique is particularly advantageous as a pretreatment for red brass.

In accordance with another embodiment of the invention, it is also possible, as a last treatment step after treatment with the water soluble carboxylic acid, to treat the plumbing fixtures with a phosphorous-containing acid, and preferably phosphoric acid. It has been found, depending somewhat on the characteristics of the plumbing fixtures and the brass alloys from which they are made, that the treatment step utilizing a phosphorous-containing acid, acid salt or salt derived from alkali metal served to substantially remove any remaining residual trace amounts of leachable lead, if any, from the plumbing fixtures and passivate the brass component against corrosion.

It has been found that the method is effective not only in the treatment of yellow brass but also in the treatment of red brass.

DETAILED DESCRIPTION OF THE INVENTION

In the practice of the present invention, a brass component of the type described which customarily comes into contact with water is first treated in a hot caustic wash. As used herein, the caustic wash is an aqueous solution of an alkali metal hydroxide and preferably sodium or potassium hydroxide having a pH above 10, and preferably above 12. In general, the concentration of alkali metal hydroxide in the aqueous solution is an amount sufficient to remove substantially all of the hydroxide-leachable lead from the brass part. In general, use can be made of caustic solutions containing from about 10 to about 50 percent alkali metal hydroxide, although higher and lower amounts of caustic may be used, depending somewhat on the treatment time desired. In general, the more concentrated the alkali metal hydroxide in solution, the shorter is the treatment time necessary to remove at least 50 percent of the leachable lead.

Another parameter affecting the treatment time for the caustic solution is the temperature. In general, higher temperatures favor shorter treatment times while lower temperatures generally necessitate longer treatment times. Best results are obtained when the temperature of the caustic solution is at least 80° F., and preferably ranges from about 100° F. to about 200° F. It is also frequently desirable to employ ultrasonic agitation of the caustic bath or the parts therein to insure maximum contact between the caustic solution and the brass. Good results are typically obtained when the entire caustic bath is subjected to ultrasonic agitation. For example, it has been found that, using ultrasonic agitation, nearly all of the hydroxide-leachable lead can be removed from the brass components in the first several minutes of treatment. Good results are obtained, depending somewhat on the temperature, the concentration and the degree of agitation, when the treatment time ranges from about one minute to about 60 minutes.

After the component has been treated with the hot caustic wash, it is then rinsed with water, and preferably deionized water, to remove any dirt adhering to the surfaces of the components as well as to remove excess alkali metal hydroxide and any lead present on the surface of the parts. The rinsing time can be varied within wide limits, but generally a rinse extending from about 0.5 to about 30 minutes is sufficient.

Thereafter, the brass component is treated with carboxylic acid to remove substantially all of the leachable lead remaining on the component. Use is preferably made of a water soluble carboxylic acid containing from 1 to 8 carbon atoms and from 1 to 4 carboxyl groups. Representative of such acids are acetic acid, propionic acid, butyric acid, iso-butyric acid, citric acid, and the like. The concentration of the acid in aqueous solution can be varied within relatively wide ranges, depending again on the temperature of the acid treatment and the duration of the acid treatment. Good results are usually obtained when the concentration of the carboxylic acid ranges from about 0.01 to about 1.0M. Once again, at least 50 percent of the acid-leachable lead is removed from the brass component during the first several minutes of treatment. In general, however it is preferred to employ acid treatment times ranging from about one minute to about 45 minutes. As will be appreciated by those skilled in the art, the use of additional treatment times is useful in the cleaning of the parts to remove deposits remaining from casting of the parts using well-known core casting techniques. Best results are typically obtained when the acid employed is acetic acid, although citric acid likewise provides highly beneficial results.

As with the caustic bath, it is also frequently desirable to employ ultrasonic agitation of the carboxylic acid bath or the parts therein to insure maximum contact between the carboxylic acid solution and the brass. Good results are typically obtained when the entire carboxylic acid bath is subjected to ultrasonic agitation.

It has been found that the combination of caustic followed by acid treatment removes substantially all of the leachable lead from the part. It has been found that the removal rate of lead can be up to two times greater in the caustic treatment step compared to that achieved for subsequent acid washing steps.

As will be appreciated by those skilled in the art, both the caustic and acid treatment steps can either be carried out in a single step in which the brass component is contacted with either the caustic solution or acid solution. As an alternative, however, it is possible, and sometimes desirable, to use a series of caustic and/or acid treatment steps. It has been found that the use of the series of treatment steps has the advantage of providing increased rates of lead removal, particularly where the treatment solutions are more dilute. Without limiting the invention as to theory, it is believed that the concentration driving force between the lead in the part and lead contained in the solution is greater when use is made of a series of caustic and/or acid treatment steps to thermodynamically drive the reactions.

One of the advantages in the practice of the invention is that the sequence of caustic and acid treatment of the brass components exhibits no wholesale attack on the brass. On the contrary, the treatment process is limited primarily to lead removal, although there can be observed some removal of zinc during the caustic wash step. Once again, without limiting the invention as to theory, the removal of zinc can be attributed to the solubility of zinc complexes at high pH and possible surface enrichment of zinc during casting of the parts.

In the optional final step of the process, the components are treated with a phosphorus-containing acid, acid salt or salt derived from alkali metal, and preferably phosphoric acid. Also suitable are alkali metal salts of phosphoric acid and alkali metal acid salts of phosphoric acid (e.g., trisodium phosphate, monosodium phosphate and disodium phosphate). Without limiting the invention as to theory, it is believed that the treatment with the carboxylic acid chemically etches the brass component, leaving a weak electrical charge. When that weakly charged brass component is rinsed with phosphoric acid, for example, most of the remaining residual trace amounts of lead, if any, are removed, and the brass component is passivated, with residual lead, if any, forming a relatively insoluble lead-phosphate. It has been found that insoluble lead phosphate is relatively impervious to the action of water. Furthermore, the phosphate passivates the metal against corrosion, effectively minimizing any further leaching of metals from the brass component into water coming in contact with the brass component. That, in turn, assures that any water coming in contact with the treated brass component contains very low levels of lead, generally below 11 parts per billion and typically below 5 parts per billion of lead in water.

As with the caustic and carboxylic acid bath, it is also frequently desirable to employ ultrasonic agitation of the phosphorus-containing acid bath or the parts therein to insure maximum contact between the phosphorus-containing acid solution and the brass. Good results are typically obtained when the entire phosphorus-containing acid bath is subjected to ultrasonic agitation.

In accordance with another alternative embodiment of the invention, it has been found advantageous, and particularly where the plumbing fixtures to be treated are formed from red brass, to employ a chemical milling pretreatment step by which surface metal is removed from the interior of such plumbing fixtures preparing the brass component for more effective removal of the leachable lead. As indicated, it is frequently preferred to employ a strong acid to remove surface metal from the interior of plumbing parts. Various acids can be used for that purpose, although it is preferred that the acid not be of such a strength as to cause excessive metal removal. As will be appreciated by those skilled in the art, the metal removal is determined not only by the acid employed, but also by its concentration, the time of immersion and the temperature. In general, use can be made of mineral acids such as hydrochloric acid, sulfuric acid, or nitric acid, either alone, or in combination with organic acids and preferably carboxylic acids. It has also been found that performance of such acids can, in appropriate cases, be enhanced through the use of oxidizing agents, and most notably peroxides (e.g., $H_2O_2$). It has been found that the use of such a chemical milling pretreatment step is particularly advantageous where, as a result of the casting operations, the interior of the plumbing fixtures undergoing treatment have a relatively high degree of surface roughness and residue.

In the preferred practice of the invention, it is also frequently desirable to rotate the various parts undergoing treatment during the treating operation. For example, such rotation can be effected during the time that the part is undergoing treatment during either the caustic or acidic treatment steps to remove air pockets which may be formed within the interior of the parts undergoing treatment. Thus the rotation of the parts during treatment ensures a more uniform treatment of the brass parts.

Having described the basic concepts of the invention, reference is now made to the following examples which are provided by way of illustration, and not by way of limitation, of the practice of the present invention.

GENERAL PROCEDURE FOR EXAMPLES

Brass fixture components were treated by submerging in a sequence of chemical baths designed to leach lead from the components. Fixtures were held on racks that allowed free flow of solution into each fixture. The baths were prepared in tanks with ultrasonic generators and electric heater coils as described below.

The first bath contained 10% sodium hydroxide and deionized water. Two ultrasonic generators and one electric heater coil were installed. The temperature of the caustic solution was maintained at 150 deg. F. Fixtures were submerged for half of the specified duration, lifted from the tank, rotated 180 degrees along the vertical axis and submerged for the remainder of the duration.

The second bath was a water rinse at ambient temperature with no ultrasonics, however air agitation was used. Fixtures were submerged for a period of approximately 1 minute.

The third bath contained a 0.1M acetic acid pre-soak solution at ambient temperature. Parts were submerged for approximately 1 minute. No ultrasonics were used, however air agitation was used.

The fourth bath contained 0.1M acetic acid solution with four ultrasonic generators and two electric heater coils. Bath temperature was maintained at 120 deg. F. Fixtures were submerged in the bath for the specified duration then lifted out of the tank and rotated 180 degrees about the vertical axis. Fixtures were again submerged for the remainder of the specified duration.

The final three tanks were deionized water counter flowing rinses with air agitation used in the second tank and ultrasonics in the final tank with two ultrasonic generators and an electric heater coil. The final tank bath temperature was maintained at 140 deg. F.

Example #1

Three yellow brass castings each with a cold mix volume of 0.085 Liters were treated with the above procedure. Castings were submerged for five minutes in a caustic bath, five minutes in an acetic acid bath and five minutes in the final rinse of deionized water and phosphoric acid. The castings were then tested with procedures required by NSF Standard 61, Section 9. The Q statistic was then determined by formulas contained in NSF Standard 61, Section 9.

| | Lead Detected [ug] | | | LN ug | | |
|---|---|---|---|---|---|---|
| Day | 1 | 2 | 3 | 1 | 2 | 3 |
| 3 | 2.21 | 2.30 | 2.64 | 0.79 | 0.83 | 0.97 |
| 4 | 1.62 | 1.62 | 1.79 | 0.48 | 0.48 | 0.58 |
| 5 | 1.28 | 1.19 | 1.45 | 0.25 | 0.17 | 0.37 |
| 10 | 0.85 | 0.84 | 1.02 | −0.16 | −0.17 | 0.02 |
| 11 | 0.68 | 0.72 | 0.85 | −0.39 | −0.33 | −0.16 |
| 12 | 0.65 | 0.70 | 0.65 | −0.43 | −0.36 | −0.43 |
| 17 | 0.41 | 0.54 | 0.59 | −0.89 | −0.62 | −0.53 |
| 18 | 0.26 | 0.27 | 0.29 | −1.35 | −1.31 | −1.24 |
| 19 | 0.43 | 0.37 | 0.43 | −0.84 | −0.99 | −0.84 |
| Average | | | | −0.28 | −0.25 | −0.14 |
| Mean | | | | −0.23 | | |
| Std Dev | | | | 0.08 | | |
| Q Test Statistic | | | | 0.97 | | |

Example #2

Three red brass castings each with a cold mix volume of 0.116 L Liters were treated with the same procedure as above. Castings were submerged for sixty minutes in a caustic bath, thirty minutes in an acetic acid bath and five minutes in the final rinse of deionized water and phosphoric acid. The castings were then tested with procedures required by NSF Standard 61, Section 9. The Q statistic was then determined by formulas contained in NSF Standard 61, Section 9.

| | Lead Detected [ug] | | | LN ug | | |
|---|---|---|---|---|---|---|
| Day | 1 | 2 | 3 | 1 | 2 | 3 |
| 3 | 12.76 | 13.92 | 13.92 | 2.55 | 2.63 | 2.63 |
| 4 | 15.08 | 12.76 | 13.92 | 2.71 | 2.55 | 2.63 |
| 5 | 11.60 | 15.08 | 16.24 | 2.45 | 2.71 | 2.79 |
| 10 | 8.93 | 15.08 | 11.60 | 2.19 | 2.71 | 2.45 |
| 11 | 5.92 | 6.50 | 7.19 | 1.78 | 1.87 | 1.97 |
| 12 | 5.57 | 6.03 | 6.15 | 1.72 | 1.80 | 1.82 |
| 17 | 7.54 | 7.42 | 8.35 | 2.02 | 2.00 | 2.12 |
| 18 | 19.72 | 7.08 | 5.92 | 2.98 | 1.96 | 1.78 |
| 19 | 7.77 | 5.68 | 6.73 | 2.05 | 1.74 | 1.91 |
| Average | | | | 2.27 | 2.22 | 2.23 |
| Mean | | | | 2.24 | | |
| Std Dev | | | | 0.03 | | |
| Q Test Statistic | | | | 10.10 | | |

Example #3

Three red brass castings each with a cold mix volume of 0.116 Liters were treated with the same procedure as above. Castings were submerged for sixty minutes in a caustic bath, thirty minutes in an acetic acid bath and five minutes in the final rinse of deionized water. The castings were then tested with procedures required by NSF Standard 61, Section 9. The Q statistic was then determined by formulas contained in NSF Standard 61, Section 9.

| | Lead Detected [ug] | | | LN ug | | |
|---|---|---|---|---|---|---|
| Day | 1 | 2 | 3 | 1 | 2 | 3 |
| 3 | 6.15 | 6.73 | 7.42 | 1.82 | 1.91 | 2.00 |
| 4 | 4.64 | 6.73 | 4.99 | 1.53 | 1.91 | 1.61 |
| 5 | 4.18 | 6.15 | 4.99 | 1.43 | 1.82 | 1.61 |
| 10 | 3.02 | 3.71 | 15.08 | 1.11 | 1.31 | 2.71 |
| 11 | 2.44 | 3.25 | 3.02 | 0.89 | 1.18 | 1.11 |
| 12 | 2.20 | 2.90 | 3.25 | 0.79 | 1.06 | 1.18 |
| 17 | 2.32 | 3.71 | 3.02 | 0.84 | 1.31 | 1.11 |
| 18 | 5.10 | 2.09 | 4.87 | 1.63 | 0.74 | 1.58 |
| 19 | 1.86 | 4.06 | 2.44 | 0.62 | 1.40 | 0.89 |
| Average | | | | 1.18 | 1.40 | 1.53 |
| Mean | | | | 1.37 | | |
| Std Dev | | | | 0.18 | | |
| Q Test Statistic | | | | 6.26 | | |

It will be understood that various changes can be made in the details of procedure, formulation and use without departing from the spirit of the invention, especially as defined in the following claims.

What is claimed:

1. A process for the treatment of brass components to reduce leaching lead therefrom when the component is exposed to water, comprising:

a) contacting the brass component with an aqueous caustic solution wherein the caustic solution is selected from the group consisting of sodium hydroxide and potassium hydroxide and has a pH above 10 to remove some of the leachable lead from the brass component, b) rinsing the brass components to remove excess caustic solution, and c) contacting the brass component with a water soluble carboxylic acid to remove substantially all of the remaining leachable lead.

2. A process as defined in claim 1 wherein the brass components are treated for a time sufficient to provide a brass component which, when contacted with water, provides a water stream containing less than 11 parts per billion of lead.

3. A process as defined in claim 1 wherein the brass components are treated for a time sufficient to provide a brass component which, when contacted with water, provides a water stream containing less than 5 parts per billion of lead.

4. A process as defined in claim 1 wherein the component is contacted with the aqueous caustic solution for a time sufficient to remove at least 50% of the leachable lead.

5. A process as defined in claim 1 wherein the brass component is contacted with the aqueous caustic solution maintained at a temperature within the range of about 100° F. to about 200° F.

6. A process as defined in claim 1 wherein the brass component is contacted with the aqueous caustic solution which is ultrasonically agitated to maintain contact between the caustic solution and the brass component.

7. A process as defined in claim 1 wherein the brass component is contacted with the aqueous caustic solution for a time ranging from about 1 minute to about 60 minutes.

8. A process as defined in claim 1 wherein the brass component is rinsed for a time sufficient to remove any dirt adhering to the component and to remove substantially all of the excess caustic solution.

9. A process as defined in claim 1 wherein the brass component is rinsed in water.

10. A process as defined in claim 1 wherein the carboxylic acid contains from 1 to 8 carbon atoms and from 1 to 4 carboxyl groups.

11. A process as defined in claim 1 wherein the carboxylic acid is selected from the group consisting of acetic acid and citric acid.

12. A process as defined in claim 1 wherein the concentration of the carboxylic acid ranges from about 0.01 to about 1.0 molar.

13. A process as defined in claim 1 wherein the brass component is pretreated with a strong acid remove surface matter and reduce surface roughness of the interior of the component.

14. A process as defined in claim 13 wherein the strong acid is a mineral acid used in combination with a carboxylic acid and a peroxide oxidizing agent.

15. A process as defined in claim 1 which includes the step of rinsing the brass component with a phosphorous-containing acid, acid salt or salt derived from alkali metal to remove any residual trace amounts of leachable lead, if any, from the brass component and passivate the metal to substantially eliminate any further leaching of lead when the brass component is exposed to water.

16. A process for the treatment of brass components to reduce leaching lead therefrom when the component is exposed to water comprising:

a) contacting the brass component with an aqueous caustic solution wherein the caustic solution is selected from the group consisting of sodium hydroxide and potassium hydroxide and has a pH above 10 to remove some of the lead from the brass component, b) rinsing the brass components with water, and c) contacting the brass component with a water soluble carboxylic acid to remove substantially all of the remaining lead, with at least one of the aqueous caustic treatment and carboxylic acid treatment being effected in the presence of ultrasonic agitation.

17. A process as defined in claim 16 which includes the step of rotating the component during contact with the aqueous caustic solution and/or during contact with the carboxylic acid to remove air pockets and promote uniform treatment of the brass component.

* * * * *